US005947698A

United States Patent [19]

Ikeda et al.

[11] Patent Number: 5,947,698

[45] Date of Patent: Sep. 7, 1999

[54] PISTON TYPE COMPRESSOR

[75] Inventors: Hayato Ikeda; Tetsuya Yamaguchi; Satoru Kuramoto; Masanobu Yokoi, all of Kariya, Japan

[73] Assignee: Kabushiki Kaisha Toyoda Jidoshokki Seisakusho, Aichi-ken, Japan

[21] Appl. No.: 08/889,868

[22] Filed: Jul. 8, 1997

[30] Foreign Application Priority Data

Jul. 9, 1996 [JP] Japan ..... 8-179466

[51] Int. Cl.[6] ..... F04B 1/12

[52] U.S. Cl. ..... 417/269; 184/6.17; 92/71

[58] Field of Search ..... 417/222.1, 222.2, 417/269; 184/6.17; 92/71

[56] References Cited

U.S. PATENT DOCUMENTS 4,360,321 11/1982 Copp, Jr. et al. ..... 417/269
5,718,566 2/1998 Ikeda et al. ..... 417/269
5,782,613 7/1998 Michiyuki et al. ..... 417/269

*Primary Examiner*—Thomas E. Denion
*Attorney, Agent, or Firm*—Morgan & Finnegan, L.L.P.

[57] ABSTRACT

An improvement of a piston type compressor is disclosed. The compressor has a cylinder block that includes a plurality of cylinder bores and a plurality of suction passages. Each of the suction passages extends through the cylinder block to connect a crank chamber with a suction chamber. The suction chamber is connected with the cylinder bores via a plurality of suction ports located in association with the cylinder bores. Each cylinder bore accommodating a piston that moves therein to circulate gas between the compressor and an external gas circuit. The gas introduced into the crank chamber from the external gas circuit is supplied to the suction chamber through each suction passage and is supplied from the suction chamber to each cylinder bore through an associated suction port. The suction passages are smaller in number than the cylinder bores. The suction ports are disposed in the vicinity of an opening of the suction passages.

18 Claims, 4 Drawing Sheets

PISTON TYPE COMPRESSOR

BACKGROUND OF THE INVENTION

1. Field of the Invention

The present invention generally relates to piston type compressors, more particularly, to piston type compressors having a cam plate.

2. Description of the Related Art

A typical piston type compressor is described below. This type or compressor includes a pair of cylinder blocks secured to each other. A front housing is coupled to the front end of the front cylinder block with a valve plate arranged in between. In the same manner, a rear housing is coupled to the rear end of the rear cylinder block with a valve plate arranged in between. A crank chamber is defined between the cylinder blocks. Further, suction and discharge chambers are defined in each housing. The cylinder blocks also include a plurality of cylinder bores and a suction passage defined therein. A double-headed piston is reciprocally housed in each cylinder bore. The valve plates are provided with a plurality of suction ports each corresponding to one of the cylinder bores. Each suction port is selectively opened and closed with a suction valve flap.

As each piston is reciprocated in the associated cylinder bore, refrigerant gas is drawn from an external refrigerant circuit into the crank chamber. The gas is then supplied to the suction chambers in the front and rear housings by the suction passage. The gas in the suction chambers is drawn into each cylinder bore through the corresponding suction port.

In the above described prior art piston compressor, each suction port is arranged on the corresponding cylinder bore at the same position with respect to the center of the valve plate. Further, all the suction valve flaps are arranged extending in the same direction with respect to the rotating direction of the drive shaft. The recent trend of increasing in the number of cylinder bores has resulted in an increased ratio of the cross-sectional area of cylinder bores to the cross-sectional area of the cylinder block. This results in a reduced cross-sectional area for forming suction passages. It is thus difficult to form the same number of suction passages as the number of cylinder bores. In other words, it is difficult to form suction passages so that each corresponds to one cylinder bore.

In a compressor having the above described construction, the pressure in each suction chamber varies from one location to another. This causes the pressure in a cylinder bore close to a suction passage to be different from the pressure in a cylinder bore far from the suction passage. The variation of suction pressures in the cylinder bores is referred to as suction pressure loss. Suction pressure loss results in unstable compression operation.

When low pressure refrigerant gas is drawn into a cylinder bore, the compression ratio needs to be relatively high for compressing the gas to a predetermined discharge pressure. In the state, the compressor takes more time until the refrigerant gas is discharged from a compression chamber. Consequently, the amount of discharge gas is decreased in accordance with the delay of discharging timing for operating the compressor. In short, the variation of the pressure in the suction chambers results in an increased power loss. Further, the temperature of the discharged gas is increased. Thus, the refrigerant capacity of the external refrigerant circuit is degraded.

Further, if a cylinder bore draws lower pressure refrigerant gas, the cylinder bore has a low suction pressure. The cylinder bore therefore draws less refrigerant gas from the external refrigerant circuit. This lowers the flow rate of the refrigerant gas in the circuit thereby increasing the pressure in the evaporator. The elevated pressure in the evaporator degrades the refrigerant capacity of the circuit.

SUMMARY OF THE INVENTION

Accordingly, it is an objective of the present invention to provide a piston type compressor that has an improved refrigerant capacity.

Another objective of the present invention is to provide a piston type compressor that operates stably.

To achieve the foregoing and other objectives and in accordance with the purpose of the present invention an improved piston type compressor having a cylinder block is provided. The cylinder block includes a plurality of cylinder bores and a plurality of suction passages. Each suction passage extends through the cylinder block to connect a crank chamber with a suction chamber. The suction chamber is connected with the cylinder bores by way of a plurality of suction ports. Each suction port Is located in association with each of the cylinder bores. Each cylinder bore accommodates a piston that moves therein to circulate gas between the compressor and an external gas circuit. The gas introduced into the crank chamber from the external gas circuit is supplied to the suction chamber through each suction passage. The gas is supplied from the suction chamber to each cylinder bore through an associated suction port. The suction passages are smaller in number than the cylinder bores. Each suction bore is disposed In the vicinity of an opening of the suction passage.

Other aspects and advantages of the invention will become apparent from the following description, taken in conjunction with the accompanying drawings, illustrating by way of example the principals of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENT

A first embodiment of the present invention will now be described with reference to the drawings. Although the present invention Is embodied in a double-headed piston type compressor in the following description, it should be apparant to those skilled in the art that the present invention may also be embodied in single-headed type compressors.

Figure 1:
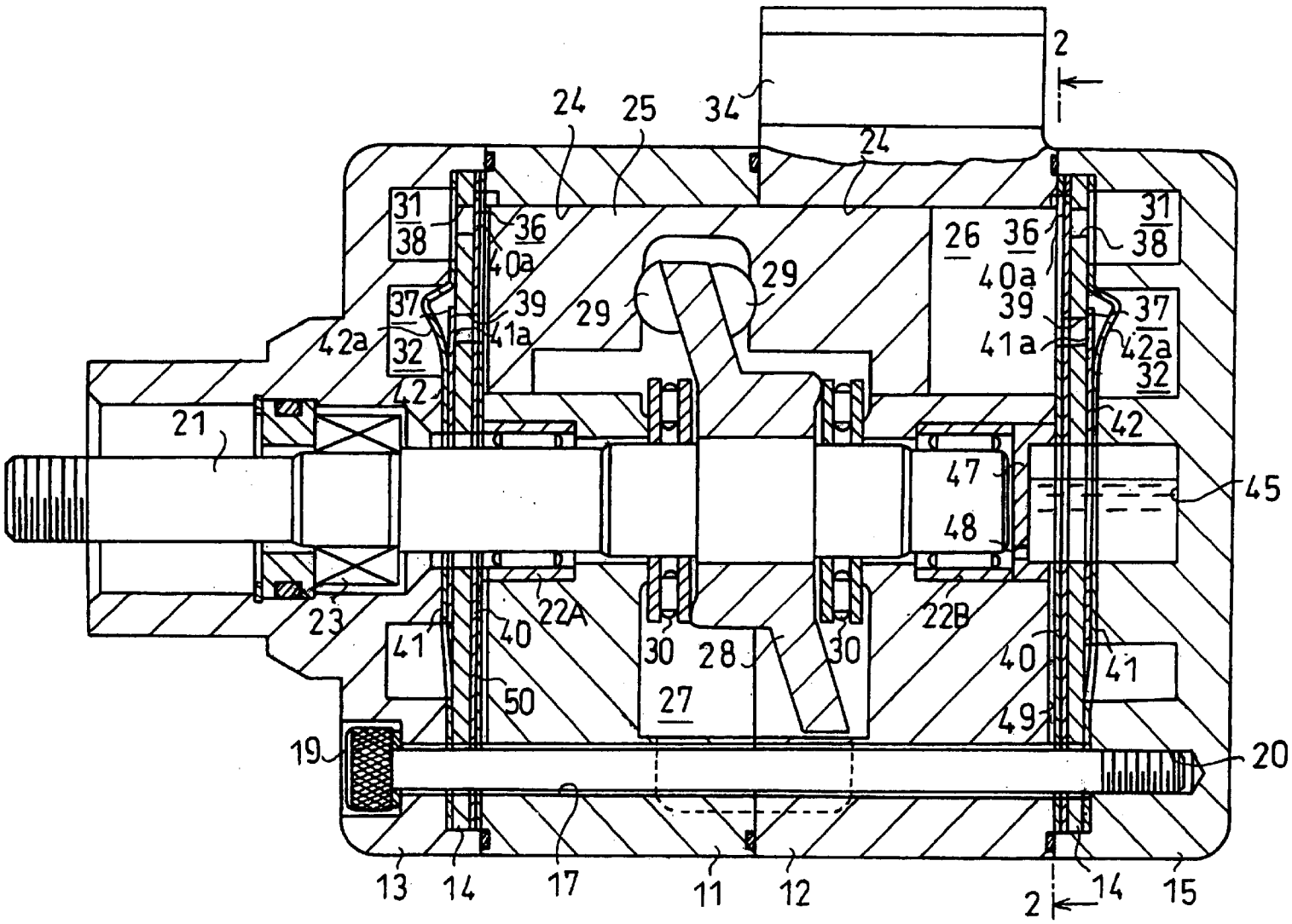
FIG. 1 is a cross-sectional view showing a double-headed piston type compresses According to a preferred embodiment of the present invention.
Figure 2:
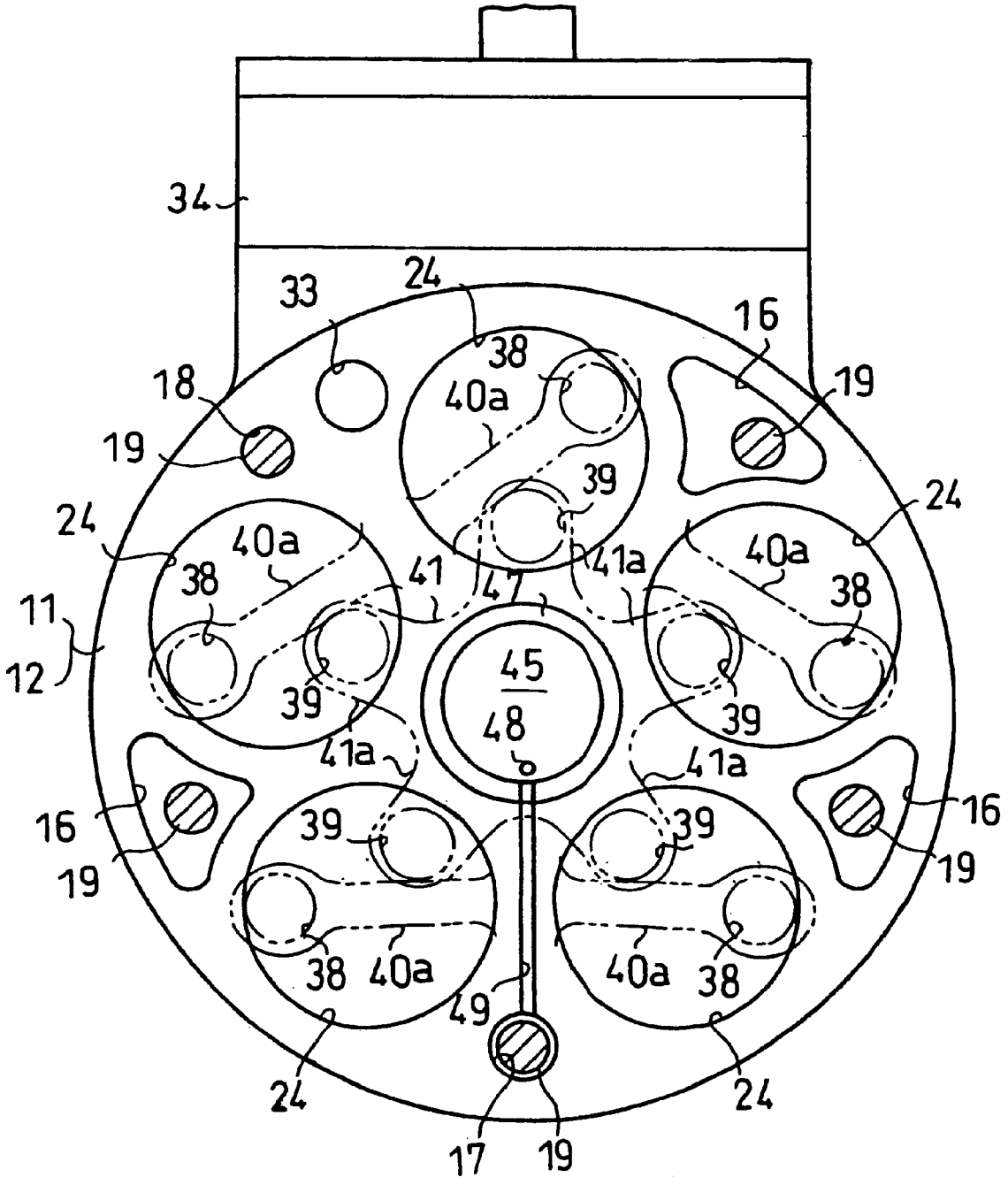
FIG. 2 is a cross-sectional view taken along line 2—2 of FIG. 1.

As shown in FIGS. 1 and 2, a pair of cylinder blocks 11, 12 are coupled to each other. A front housing 13 is coupled to the front end of the front cylinder block 11 with a metal valve plate 14 arranged in between. In the same manner, a rear housing 15 is coupled to the rear and of the cylinder block 12 with another metal valve plate 14 arranged in between.

Five bolt holes 16, 17, 18 extend between the front housing 13 and the rear housing 15. Each of the bolt holes 16, 17, 18 extends through the front housing 13, the front valve plate 14, the cylinder blocks 11, 12, the rear valve plate 14, and the rear housing 15. The holes 16, 17, 18 are arranged on the same circumference, that is, at the same distance form the center of the plate 14, and are spaced equally apart. A bolt 19 is inserted into each of the bolt holes 16, 17, 18 from the front housing 13 and screwed into a threaded hole 20 provided in the rear housing 15. The bolts 19 fasten the front housing 13 and the rear housing 15 to the cylinder blocks 11, 12 with the valve platen 14 arranged in between.

Each of the cylinder blocks 11, 12 and the front housing 13 has a shaft hole defined in the center portion. A drive shaft 21 is rotatably supported in the shaft holes by a pair of radial bearings 22A, 22B, which are provided in the shaft hole of the front cylinder block 11 and in the shaft hole in the rear cylinder block 12, respectively. The rear end of the whaft hole of the roar housing 12 is closed with a cap member 47. A lip seal 23 is arranged in the shaft hole of the front housing 13 between the periphery of the front end of the drive shaft 21 and the shaft hole. The drive shaft 21 is operably connected to an external drive source such as a vehicle engine by a clutch mechanism (not shown). Connection of the clutch mechanism transmits the drive force of the external drive source to the drive 5haft 21 and rotate the whaft 21.

Five cylinder bores 24 extend through the cylinder blocks 11, 12 parallel to the axis of the drive shaft 21. The cylinder bores 24 are spaced equally apart from one another along a circle that is coaxial with the drive shaft 21. A double-headed piston 25 is reciprocally accommodated in each cylinder bore 24. In each cylinder bore 24, a front compression chamber 26 is defined between a front head of the piston 25 and the associated front valve plate 14, while a rear compression chamber 26 is defined between the rear head of the piston 25 and the associated rear valve plate 14.

A crank chamber 27 is defined between the cylinder blocks 11, 12. A swash plate 28 is fixed to the drive shaft 21 in the crank chamber 27. The peripheral portion of the swash plate 28 is connected to the middle of each piston 25 by means of shoes 29. The rotation of the drive shaft 21 causes the swash plate 28 to reciprocate each piston 25.

A pair of thrust bearings 30 are arranged between the front side of the swash plate 28 and the cylinder block 11 and between the rear side of the swash plate 28 and the cylinder block 12. The swash plate 28 is held between the cylinder blocks 11, 12 with the thrust bearings arranged in between. When the compressor is operating, the thrust bearings 30 transmit compression reactive force in the thrust direction acting on the swash plate 28 to the cylinder blocks 11, 12.

Figure 3:
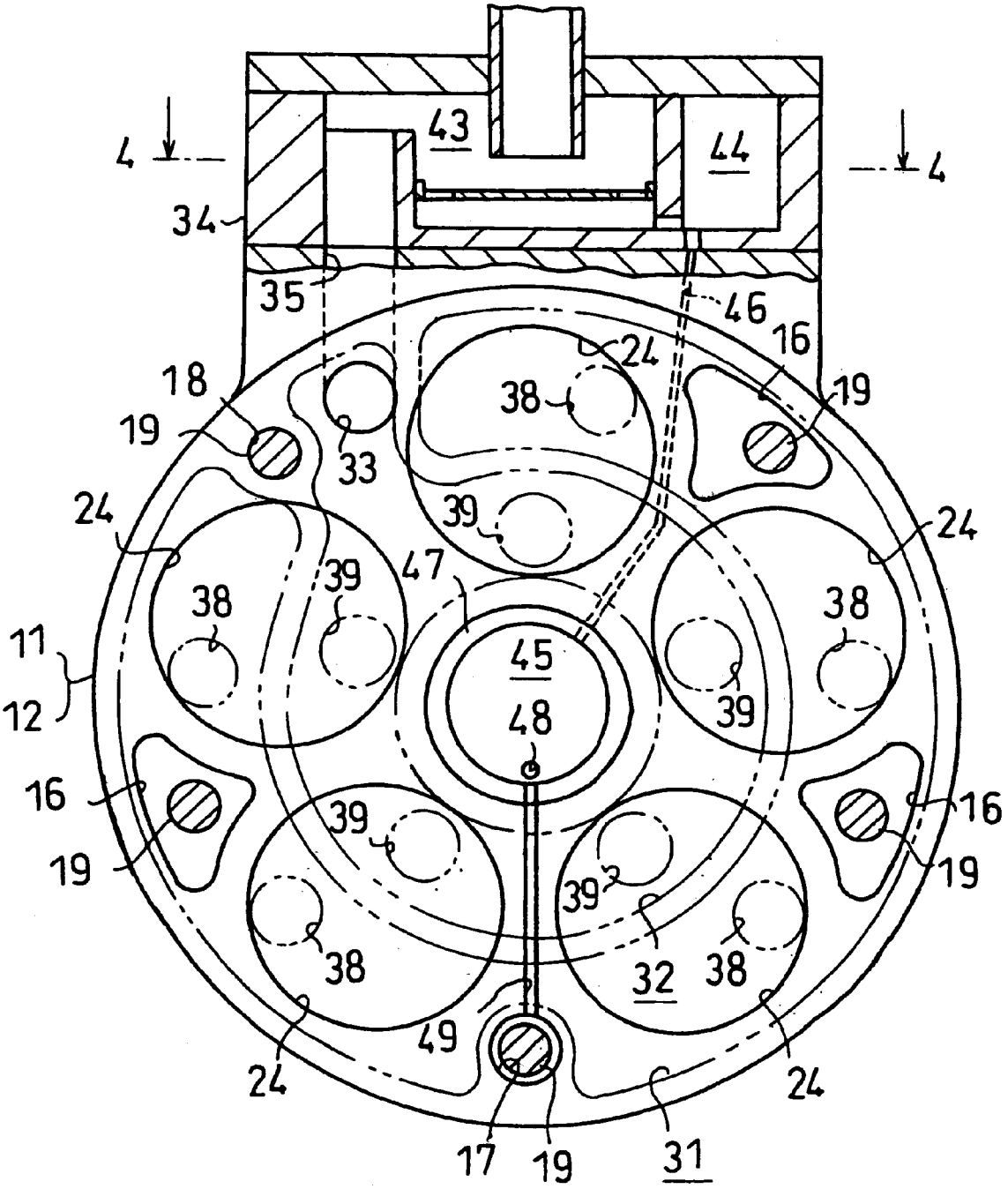
FIG. 3 is a cross-sectional view illustrating a lubricating mechanism in the compressor of FIG. 1.

As shown in FIGS. 1 and 3, a substantially annular auction chamber 31 is defined in the peripheral portion of the front and rear housings 11, 12. As shown in FIG. 2, the bolt hole 17 is located in the vicinity of the bottom of the cylinder blocks 11, 12 and the bolt hole 18 is located in the vicinity of a discharge passage 33, which will be discussed later. The rest of the bolt holes that is, the bolt holes 16, also serve as suction passages. The number of the suction passage is three and is less than the number of the cylinder bores 24, which is five in this embodiment.

The bolt holes 16, which also function as auction passages, have a substantially triangular cross-section. The cross-section area of each hole 16 is sufficiently larger than the cross-sectional area of the bolts 19. The inner ends of the passages 16 are connected to the crank chamber 27, while the outer ends are connected to the front and rear auction chambers 31. Refrigerant gas in drawn into the crank chamber 27 from an external refrigerant circuit (not shown). The gas in the chamber 27 is then led to the suction chambers 31 through the suction passages 16.

An annular discharge chamber 32 is defined in the center portion of the front and rear housings 13, 15. A discharge passage 33 extends through the cylinder blocks 11, 12 and connects the front and rear discharge chambers 32. A discharge muffler 34 is provided at the upper peripheral section of the rear cylinder block 12. The muffler 34 is communicated with the discharge passage 33 by a bore 35. Refrigerant gas in the front and rear discharge chambers 32 is discharged to the external refrigerant circuit (not shown) via the discharge passage 33, the bore 35 and the discharge muffler 34.

The bolt hole 12 is located in the vicinity of the discharge passage 33. The diameter of the hole 18 is substantially the same as the diameter of the bolts 19. The hole 18 thus functions only to accommodate the associated bolt 18 but does not function as a suction passage.

A suction valve mechanisms 36 are provided between the valve plates 14 cylinder blocks 11, 12. When the pistons 25 reciprocate, the suction valve mechanisms 36 allow refrigerant gas in the suction chambers 31 to be drawn into each compression chamber 26. Discharge valve mechanisms 37 are provided between the valve plate 14 and the front and rear housings 13, 15, respectively. When the pistons 25 reciprocate, the discharge valve mechanisms 37 allow refrigerant gas that is compressed In the compression chamber 26 to be discharged to the discharge chambers 32.

The structure of the suction valve mechanism 36 and the structure of the discharge mechanism 37 will hereafter be described. As shown in FIGS. 1 to 3, the valve plate 14 includes suction ports 38 and discharge ports 39 defined therein. Each intake port 38 and each discharge port 39 correspond to one of the cylinder bore 24. Each suction port 38 is located in the vicinity of one of the suction passages 16, and the same distance exists between each port 38 and the opening of the corresponding passage 16. The discharge ports 39 are located in the vicinity of the center of the valve plate 14.

Each intake valve mechanism 36 includes a metal plate 40 having five suction valve flaps 40*a*. Each flap 40*a* corresponds to one of the emotion ports 38 and closes and opens the corresponding suction port 38. Each valve flap 40*a* extends along the diameter of the associated cylinder bore 24 toward the adjacent suction passage 16 with its distal aligned with the inner periphery of the corresponding cylinder bore 24.

Each discharge valve mechanism 37 includes a metal plate 41, which functions as valve flaps, and a metal retainer plate 42, which also functions as a gasket. Both sides of the retainer plate 42 are coated with rubber. The plate 41 has five discharge valve flaps 41*a*, each corresponding to one of the discharge ports 39. The retainer plate 42 has retainers 42*a* for defining the opening of the discharge valve flaps 41*a*.

Figure 4:
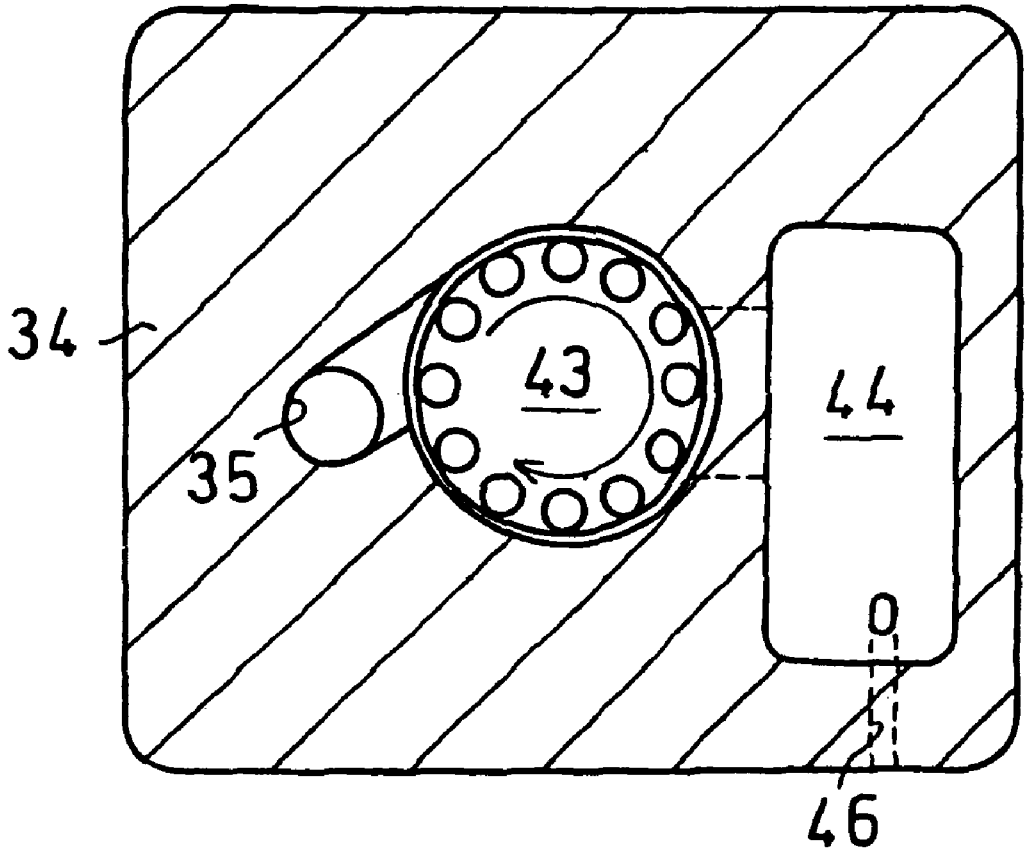
FIG. 4 is a cross-sectional view taken along line 4—4 in FIG. 3.

As shown in FIGS. 1, 3 and 4, a cyclone type oil separating chamber 43 is defined in the discharge muffler 34. The chamber 43 is communicated with a first oil storing chamber 44 defined next to the chamber 43. Refrigerant gas in the discharge chambers 32 is drawn into the oil separating chamber 43 through the discharge passage 33 and the bore 35. The gas is then rotated along the inner wall of the chamber 43. The centrifugal force of the gas rotation separates lubricant oil from the refrigerant gas. The separated lubricant oil is stored in the first oil storing chamber 44.

A second oil storing chamber 45 is defined in the center portion of the rear housing 15 and in the rear portion of the shaft hole of the rear cylinder block 12. The chamber 45 is communicated with the first oil storing chamber 44 by a restricting passage 46. The passage 46 leads lubricant oil in the first oil storing chamber 44 to the second oil storing chamber 45. Part of the lubricant oil in the chamber 45 is supplied to the rear radial bearing 22B through a lubricant passage 48 formed in the cap member 47 and lubricates the bearing 22B.

A first oil groove 49 is formed on the rear end face of the cylinder block 12. The upper end of the groove 49 is communicated with the second oil storing chamber 45 and the lower end is communicated with the bolt hole 17, which is defined in the bottom portion of the cylinder blocks 11, 12. A second oil groove 50 is formed on the front end face of the cylinder block 11. The upper end of the groove 50 is communicated with the front end of the shaft hole of the cylinder block 11 and the lower end is communicated with the bolt hole 17.

The bolt hole 17 has a larger diameter than that of the bolt 19 and functions as a lubricant passage that is disconnected from the crank chamber 27. The lubricant oil in the second oil storing chamber 45 is supplied to the front radial bearing 22A by the first oil groove 49, the bolt hole 17, which functions as a lubricant passage, and the second oil groove 50 and lubricates the bearing 22A and the lip seal 23.

The operation of the above described double-headed piston type compressor will hereafter be described.

When the drive shaft 21 is rotated by the external drive source such as a vehicle engines the rotation of the shaft 21 causes the swash plate 28 to rotate therewith. The rotation of the swash plate 28 is converted to linear reciprocation of each piston 25 in the associated bore 24. The reciprocation of each piston 25 draws refrigerant gas in the external refrigerant circuit (not shown) into the crank chamber 27. The gas in the crank chamber 27 is then led to the front and rear suction chambers 31 by the suction passages 16. A movement of each piston 25 from the top dead center to the bottom dead center opens the corresponding suction valve 40*a* thereby drawing the gas in the suction chambers 31 into the compression chamber 26 defined in the cylinder bore 24 through the intake port 38. The movement of the piston 25 from the bottom dead center to the top dead center compresses the gas in the compression chamber 26 until the pressure of the gas reaches a certain level. The compressed gas causes the discharge valve flap 41*a* to flex to open and is discharged to the discharge chamber 32 through the corresponding discharge port 39. The discharge passage 33 and the bore 35 lead the gas in the discharge chamber 32 to the discharge muffler 34. The oil separating chamber 43 in the muffler 34 separates lubricant oil from the refrigerant gas with centrifugal force. The residual gas is supplied to the external refrigerant circuit.

The lubricant oil that is separated from the refrigerant gas in the separating chamber 43 is led to the second oil storing chamber 45 through the first oil storing chamber 44 and the restricting passage 46. The oil is temporarily stored in the second chamber 45. The lubricant oil in the chamber 45 is supplied to the rear radial bearing 22B by the passage 48 and is also supplied to the front radial bearing 22A by first oil groove 49, the lubricant passage 17 and the second oil groove 50.

In this compressor, the number of the suction passages 16 is less than the number of the cylinder bores 24. Each suction port 38 is formed close to one of the suction passages 16. In other words, the distance between each suction port 38 and the corresponding suction passage 16 is short. This lowers the flow resiatence when refrigerant gas in the suction chamber 31 is drawn into each cylinder bore 24 through the corresponding suction port 38. Further, refrigerant gas is directly drawn into the cylinder bores 24 from the suction passages 16 through the suction ports 38. This suppresses differences of suction pressure (suction pressure loss) among the cylinder bores 24. The compression of the compressor is thus stabilized. Also the efficiency of the suction of refrigerant gas into the cylinder bores 24 is enhanced. The amount of refrigerant gas drawn into the crank chamber 27 from the external refrigerant circuit is increased, accordingly. Further, the pressure in a particular cylinder bore 24 is prevented from being significantly higher than that of the other bores 24. This lowers power loss and improves the refrigerant capacity of the compressor. The compression efficiency is thus further improved.

Each suction valve flap 40*a* extends toward and is directed to one of the suction passages 16. This facilitates the opening of the suction valve flaps 40*a* in the cylinder bores 24. This further lowers flow resistance and suction pressure loss. Also, the efficiency of suction of refrigerant gas into the cylinder bores 24 is further improved.

Each suction valve flap 40*a* extenda along the diameter of the corresponding cylinder bore 24 with the proximal end aligned with the inner circumference of the corresponding cylinder bore 24. This ensures that the length of each flap 40*a* is sufficient thereby facilitating the opening of the flaps 40*a*. The efficiency of suction of refrigerant gas into the cylinder bores 24 is thus further improved.

The five bolt holes 16, 17, 18 are formed in the cylinder blocks 11, 12 to accommodate the bolts 19. Among the holes 16 to 18, the three bolt holes 16 also function as the suction passages. This helps to maximize the cross-sectional area of the cylinder blocks 11, 12. Further, the bolt hole 17, which does not function as a suction passage, can be utilized as a lubricant passage.

The bolt holes 16 are formed to function as suction passages, but the bolt hole 17, which is located in the bottom portion of the cylinder blocks 11, 12, is not formed to function as a suction passage. The bolt hole 17 can therefore be utilized as a lubricant passage. This facilitates supply of lubricant oil to the front and rear radial bearings 22A, 22B and the lip seal 23.

The bolt holes 16 arc formed to function as suction passages, but the bolt hole 18, which is located in the vicinity of the discharge passage 33, is not formed to function as a suction passage. This ensures a long distance between the suction passages 16 and the discharge passage 33 thereby improving the sealing between the passages 16 and 33, which have pressures that greatly differ. Accordingly, gas leakage between the passages 16 and 33 is prevented. Consequently, the compression efficiency of the compressor is improved.

Although only one embodiment of the present invention has been described herein, it should be apparent to those skilled in the art that the present invention may be embodied in many other specific forms without departing from the spirit or scope of the invention. Particularly, it should be understood that the invention may be embodied in the following forms.

(1) The holes 16 may function solely as bolt holes and suction passages may be formed at different locations from the holes 16.

(2) Contrary to tho preferred embodiment, the suction chambers 31 may be defined in the center portion of the housings 13, 15 and the discharge chambers 32 may be formed in the peripheral portion of the housings 13, 15.

(3) The number of the holes 16, which function as suction passages and bolt holes, may be changed. For example, two or four holes 16 may be formed in the pair of cylinder blocks.

(4) The present invention may be embodied in double-headed piston type compressors having different numbers of cylinders from the preferred embodiment. For example, the invention may be embodied in compressors having 2, 4, 6, 8 or 12 cylinders, (5) The present invention may be embodied in other types of compressors that include double-headed pistons or single-headed pistons. For example, the invention may be embodied in wave cam plate type compressors.

Therefore, the present examples and embodiments are to be considered as illustrative and not restrictive and the invention is not to be limited to the details given herein, but may be modified within the scope and equivalence of the appended claims.

What is claimed is:

1. A piston type compressor having a cylinder block that includes a plurality of cylinder bores and a plurality of suction passages, each of said passages extending through the cylinder block to connect a crank chamber with a suction chamber, said suction chamber being connected with the cylinder bores by way of a plurality of suction ports, each of said suction ports being located in association with each of said cylinder bores, each of said cylinder bores accommodating a piston that moves therein to circulate gas between the compressor and an external gas circuit, wherein said gas introduced into the crank chamber from the external gas circuit is supplied to the suction chamber through each suction passage, and wherein said gas is supplied from the suction chamber to each cylinder bore through an associated suction port, wherein:

the number of said suction passages in said plurality of suction passages being fewer in number than the number of said cylinder bores in said plurality of cylinder bores; and each of said suction ports being located adjacent to one of said suction passages each suction port being spaced from its adjacent suction passage opening by substantially the same distance.

2. The compressor as set forth in claim 1 further comprising:

a housing attached to the cylinder block to form an outer shell of the compressor in cooperation with the cylinder block;

a plurality of bolts for securing the housing to the cylinder block; and said housing having a plurality of first through holes and said cylinder blocks having a plurality of second through holes in association with the first through holes, said first through holes and the associated second holes forming a plurality of bolt holes respectively receiving said bolts, wherein a portion of said plurality of the bolt holes serves as the suction passages.

3. The compressor as set forth in claim 2 further comprising:

a discharge chamber for receiving the gas compressed by the piston in the cylinder bore; and discharge passages for connecting the cylinder bores with the discharge chamber, wherein said bolt holes serving as the suction passages are remote from the discharge passage.

4. The compressor as set forth in claim 3 further comprising:

an oil passage for guiding oil that lubricates an interior of the compressor, wherein said oil passage including at least one bolt hole other than the bolt holes serving as the suction passages.

5. The compressor as set forth in claim 1 further comprising a plurality of flapper valves located in association with the suction ports, each of said flapper valves respectively opening and closing the associated suction port.

6. The compressor as set forth in claim 5, wherein said flapper valve radially extends from an inner periphery of the cylinder bore.

7. The compressor as set forth in claim 6, wherein said flapper valve is directed towards the opening of the suction passage.

8. The compressor as set forth in claim 1, wherein said suction ports are equally distant from the opening of the associated suction passages.

9. A piston type compressor having a cylinder block that forms an outer shell in cooperation with a front housing and a rear housing respectively attached to end surfaces of the cylinder block, said cylinder block including a plurality of cylinder bores and a plurality of suction passages, each of said passages extending through the cylinder block to connect a crank chamber with a suction chamber, said suction chamber being connected with the cylinder bores by way of a plurality of suction ports, each of said suction ports being located in association with each of said cylinder bores, each of said cylinder bores accommodating a double-headed piston that moves therein to circulate gas between the compressor and an external gas circuit, wherein said gas introduced into the crank chamber from the external gas circuit is supplied to the suction chamber through each suction passage, and wherein said gas is supplied from the suction chamber to each cylinder bore through an associated suction port, wherein:

the number of said suction passages in said plurality of suction passages being fewer in number than the number of said cylinder bores in said plurality of cylinder bores; and each of said suction ports being located adjacent to one of said suction passages each suction port being spaced from its adjacent suction passage opening by substantially the same distance.

10. The compressor as set forth in claim 9 further comprising:

a plurality of bolts for securing the housings to the cylinder block; and said housing having a plurality of first through holes and said cylinder blocks having a plurality of second through holes in association with the first through holes, said first through holes and the associated second holes forming a plurality of bolt holes respectively receiving said bolts, wherein a portion of said plurality of the bolt holes serves as the suction passages.

11. The compressor as set forth in claim 10 further comprising:

a discharge chamber for receiving the gas compressed by the piston in the cylinder bore; and discharge passages for connecting the cylinder bores with the discharge chamber, wherein said bolt holes serving as the suction passages are remote from the discharge passage.

12. The compressor as set forth in claim 11 further comprising:

an oil passage for guiding oil that lubricates an interior of the compressor, wherein said oil passage including at least one bolt hole other than the bolt holes serving as the suction passages.

13. The compressor as set forth in claim 9 further comprising a plurality of flapper valves located in association with the suction ports, each of said flapper valves respectively opening and closing the associated suction port.

14. The compressor as set forth in claim 13, wherein said flapper valve radially extends from an inner periphery of the cylinder bore.

15. The compressor as set forth in claim 14, wherein said flapper valve is directed towards the opening of the suction passage.

16. The compressor as set forth in claim 9, wherein said suction ports are equally distant from the opening of the associated suction passages.

17. A cylinder block for a piston type compressor comprising:

a front end;

a rear end opposite to the front end;

a plurality of cylinder bores;

a plurality of suction passages extending through the cylinder block, each of the suction passages having respective openings facing said front end and said rear end of the cylinder block, wherein the suction passages are fewer in number than the cylinder bores; and a plurality of suction ports, each suction port being located adjacent to one of the suction passage openings, wherein the distances between each suction port and its adjacent opening are substantially the same.

18. A cylinder block for a piston type compressor comprising:

a front end;

a rear end opposite to the front end;

a plurality of cylinder bores;

a plurality of suction ports respectively associated with said cylinder bores, a plurality of suction passages extending through the cylinder block, the number of said suction passages in said plurality of suction passages being fewer than the number of said cylinder bores in said plurality of cylinder bores, and a suction pressure adjustment mechanism located between the cylinder bores and the suction passages, wherein the suction pressure adjustment mechanism includes a plurality of flap valves respectively operatively associated with said suction ports to substantially equalize the suction pressures in the cylinder bores.

* * * * *

UNITED STATES PATENT AND TRADEMARK OFFICE

CERTIFICATE OF CORRECTION

PATENT NO. : 5,947,698
DATED : September 7,1999
INVENTOR(S) : H.IKeda et al.

It is certified that error appears in the above-identified patent and that said Letters Patent is hereby corrected as shown below:

Column 2, line 30, change "In" to --in--;

Column 2, line 44, change "According" to --according--;

Column 2, line 65, change "and" to --end--;

Column 3, line 12, change "platen" to --plates--;

Column 3, line 19, change "whaft" to --shaft--;

Column 3, line 20, change "roar" to --rear--;

Column 3, line 27, change "5haft" to --shaft--; change "rotate" to--rotates--;

Column 3, line 28, change "whaft" to --shaft--;

Column 3, line 60, after "holes" and before "that" insert a coma -- , --;

UNITED STATES PATENT AND TRADEMARK OFFICE

CERTIFICATE OF CORRECTION

PATENT NO. : 5,947,698
DATED : September 7, 1999
INVENTOR(S) : H. Ikeda et al.

It is certified that error appears in the above-identified patent and that said Letters Patent is hereby corrected as shown below:

Column 3, line 64, change "auction" to --suction--;

Column 4, line 2, change "auction" to --suction--;

Column 4, line19, change "12" to --18--;

Column 4, line 32, change "In" to --in--;

Column 4, line 47, change "emotion" to --suction--;

Column 5, line 33, change "engines" to --engine,--;

UNITED STATES PATENT AND TRADEMARK OFFICE

CERTIFICATE OF CORRECTION

PATENT NO. : 5,947,698

DATED : September 7, 1999

INVENTOR(S) : H. Ikeda et al.

It is certified that error appears in the above-identified patent and that said Letters Patent is hereby corrected as shown below:

Column 6, line 26, change "extenda" to --extends--;

Column 6, line 48, change "arc" to --are--;

Column 7, line 1, change "tho" to --the--;

Column 7, line 43, after "passages" and before "each" insert a coma -- , --;

Column 8, line 41, start new indented line after the semi-colon;

Column 8, line 42, after "passages" and before "each" insert a coma -- , --;

Column 10,line 12,change the comma"," to a semi-colon--;--

Signed and Sealed this

Fifth Day of December, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,947,698
DATED : September 7, 1999
INVENTOR(S) : H. Ikeda et al.

It is certified that error appears in the above-identified patent and that said Letters Patent is hereby corrected as shown below:

Column 1,
Line 37, after "increasing" delete "in";
Line 57, change "the", first occurrence, to -- this --;

Column 2,
Line 12, change "stably" to -- stabily --;

Column 3,
Line 7, change "form" to -- from --;
Line 61, delete "the"; change "passage" to -- passages --;

Column 4,
Line 24, delete "A"; change "suction" to -- Suction --;
Line 39, change "bore" to -- bores --;
Line 50, after "distal" insert -- end --;
Line 54, after "functions as" and before "valve" insert -- a --; change "flaps" to -- flap --;

Column 5,
Line 40, change "A" to -- The --;

Column 6,
Line 4, change "resiatence" to -- resistance --;

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*